US005944205A

United States Patent [19]

LaJoie et al.

[11] Patent Number: 5,944,205

[45] Date of Patent: Aug. 31, 1999

[54] AUTOMATIC AIR VENTING RIGID PLASTIC BABY BOTTLE

[76] Inventors: Ronald J. LaJoie, 1304 Briarwood Ct., Rocky Hill, Conn. 06067; Joseph S. Ciarcia, 161 F-6 Cynthia La., Middletown, Conn. 06457

[21] Appl. No.: 09/010,754

[22] Filed: Jan. 22, 1998

[51] Int. Cl.[6] ..... A61J 9/04

[52] U.S. Cl. ..... 215/11.5; 220/89.1

[58] Field of Search ..... 215/11.1, 11.4, 215/11.5; 220/89.1, 661, 913

[56] References Cited

U.S. PATENT DOCUMENTS

| | | | |
|---|---|---|---|
| 1,280,942 | 10/1918 | Apple | 215/11.5 |
| 1,669,892 | 3/1928 | Beck | 215/11.5 |
| 2,174,361 | 9/1939 | Condon | 215/11.5 |
| 2,330,019 | 9/1943 | Vaughn et al. | 215/11.5 |
| 3,071,272 | 1/1963 | Doner | 215/11.1 |
| 4,401,224 | 8/1983 | Alonso | 215/11.5 |
| 5,117,999 | 6/1992 | Canzano et al. | 220/89.1 X |
| 5,211,298 | 5/1993 | Block | 215/11.5 |
| 5,499,729 | 3/1996 | Greenwood et al. | 215/11.5 |
| 5,758,786 | 6/1998 | John | 215/11.1 X |

*Primary Examiner*—Gary E. Elkins
*Assistant Examiner*—Tri M. Mai

[57] ABSTRACT

A vented baby bottle is provided comprising a container including a circular bottom face and a peripheral side wall integrally coupled thereto and extending upwardly therefrom for defining an interior space and a top. The top is adapted for removably coupling with a nipple. An upper portion of the container includes a bore formed therein. A valve is situated within the bore of the container. Upon a suction being applied to the interior space of the container, air enters the container through the valve for equalizing pressure therein.

2 Claims, 2 Drawing Sheets

AUTOMATIC AIR VENTING RIGID PLASTIC BABY BOTTLE

BACKGROUND OF THE INVENTION

1. Field of the Invention

The present invention relates to vented baby bottles and more particularly pertains to a new automatic air venting rigid plastic baby bottle for facilitating feeding from a bottle.

2. Description of the Prior Art

The use of baby bottles is known in the prior art. More specifically, baby bottles heretofore devised and utilized are known to consist basically of familiar, expected and obvious structural configurations, notwithstanding the myriad of designs encompassed by the crowded prior art which have been developed for the fulfillment of countless objectives and requirements.

Known prior art baby bottles include U.S. Pat. No. 5,285,261; U.S. Pat. No. 4,821,896; U.S. Pat. No. 3,059,797; U.S. Pat. No. 2,493,380; U.S. Pat. No. 4,828,126; and Foreign Patents WO 93/19719 and WO 97/05853.

In these respects, the automatic air venting rigid plastic baby bottle according to the present invention substantially departs from the conventional concepts and designs of the prior art, and in so doing provides an apparatus primarily developed for the purpose of facilitating feeding from a bottle.

SUMMARY OF THE INVENTION

In view of the foregoing disadvantages inherent in the known types of baby bottles now present in the prior art, the present invention provides a new automatic air venting rigid plastic baby bottle construction wherein the same can be utilized for facilitating feeding from a bottle.

The general purpose of the present invention, which will be described subsequently in greater detail, is to provide a new automatic air venting rigid plastic baby bottle apparatus and method which has many of the advantages of the baby bottles mentioned heretofore and many novel features that result in a new automatic air venting rigid plastic baby bottle which is not anticipated, rendered obvious, suggested, or even implied by any of the prior art baby bottles, either alone or in any combination thereof.

To attain this, the present invention generally comprises a rigid container having a circular bottom face and a peripheral side wall integrally coupled thereto and extending upwardly therefrom for defining an interior space. As shown in FIG. 1, the peripheral side wall includes a lower portion with a cylindrical configuration and an upper portion with a frusto-conical configuration. The upper portion has an annular peripheral lip integrally coupled to its top and extends upwardly therefrom. The lip is equipped with a threaded outer periphery for removably coupling with a nipple. The upper portion of the container further includes a circular bore formed therein adjacent to an interconnection between the upper portion and lower portion of the container. Lastly, a disk-shaped valve formed from an elastomeric material is provided. The valve has a circular outer periphery coupled within an inner periphery of the bore of the container. The valve further includes a normally closed central hole formed therein. Upon a suction being applied to an interior space of the container, as in the case of a baby drinking from the bottle, air enters the container through the bore for equalizing pressure therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new automatic air venting rigid plastic baby bottle apparatus and method which has many of the advantages of the vented baby bottle mentioned heretofore and many novel features that result in a new automatic air venting rigid plastic baby bottle which is not anticipated, rendered obvious, suggested, or even implied by any of the prior art vented baby bottle, either alone or in any combination thereof.

It is another object of the present invention to provide a new automatic air venting rigid plastic baby bottle which may be easily and efficiently manufactured and marketed.

It is a further object of the present invention to provide a new automatic air venting rigid plastic baby bottle which is of a durable and reliable construction.

An even further object of the present invention is to provide a new automatic air venting rigid plastic baby bottle which is susceptible of a low cost of manufacture with regard to both materials and labor, and which accordingly is then susceptible of low prices of sale to the consuming public, thereby making such automatic air venting rigid plastic baby bottle economically available to the buying public.

Still yet another object of the present invention is to provide a new automatic air venting rigid plastic baby bottle which provides in the apparatuses and methods of the prior art some of the advantages thereof, while simultaneously overcoming some of the disadvantages normally associated therewith.

Still another object of the present invention is to provide a new automatic air venting rigid plastic baby bottle for facilitating feeding from a bottle.

Even still another object of the present invention is to provide a new automatic air venting rigid plastic baby bottle that includes a container having a circular bottom face and a peripheral side wall integrally coupled thereto and extending upwardly therefrom for defining an interior space and a top. The top is adapted for removably coupling with a nipple. An upper portion of the container includes a bore formed therein. A valve is situated within the bore of the container. Upon a suction being applied to the interior space of the container, air enters the container through the valve for equalizing pressure therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
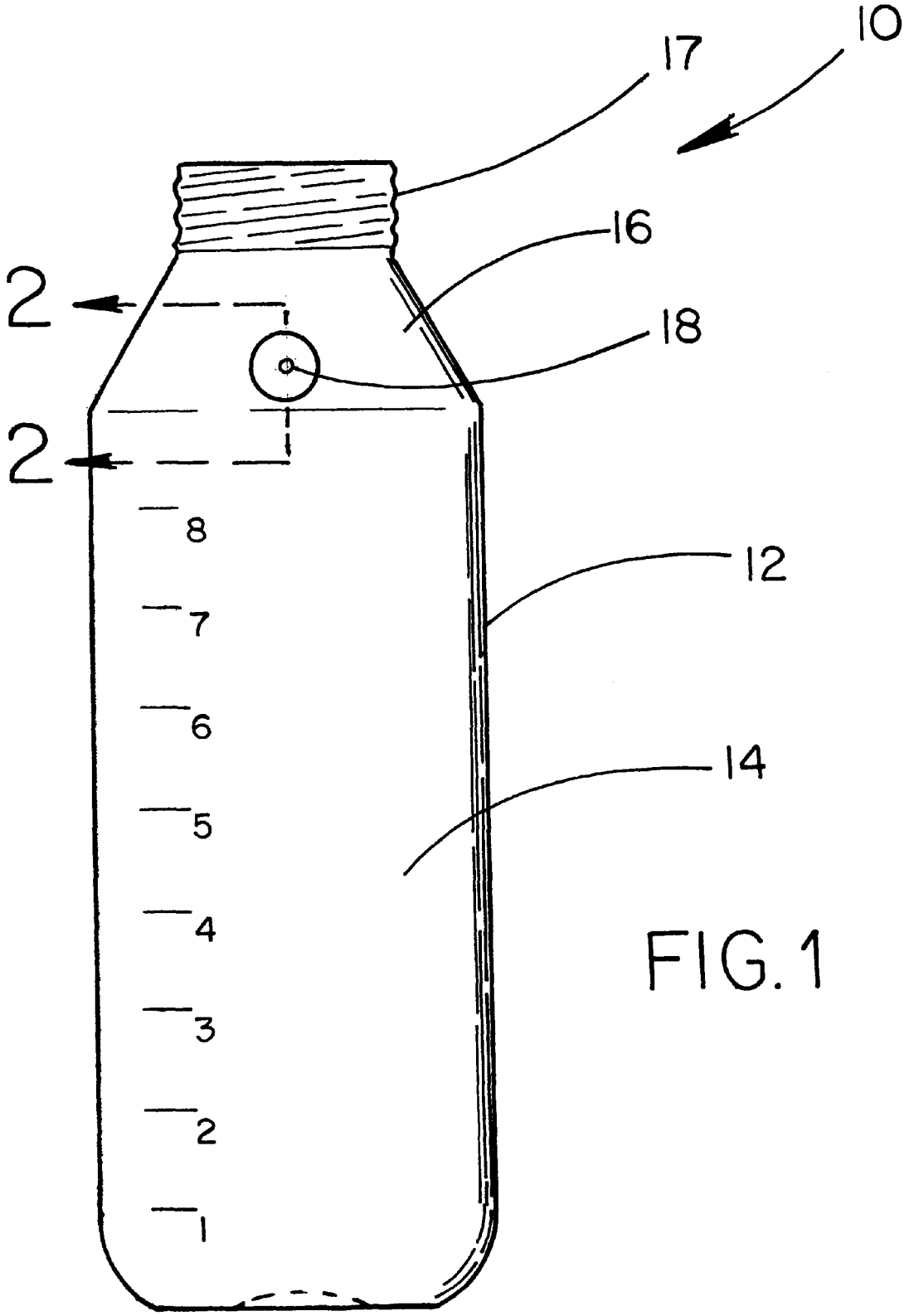
FIG. 1 is a side view of a new automatic air venting rigid plastic baby bottle according to the present invention.
Figure 2A:
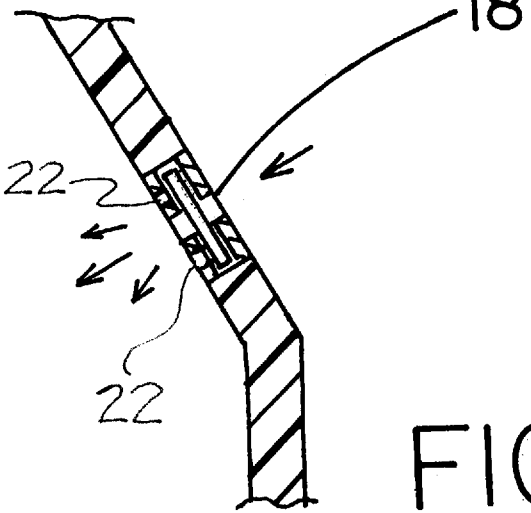
FIG. 2A is a cross-sectional view of an alternate embodiment of the valve of the present invention.
Figure 2:
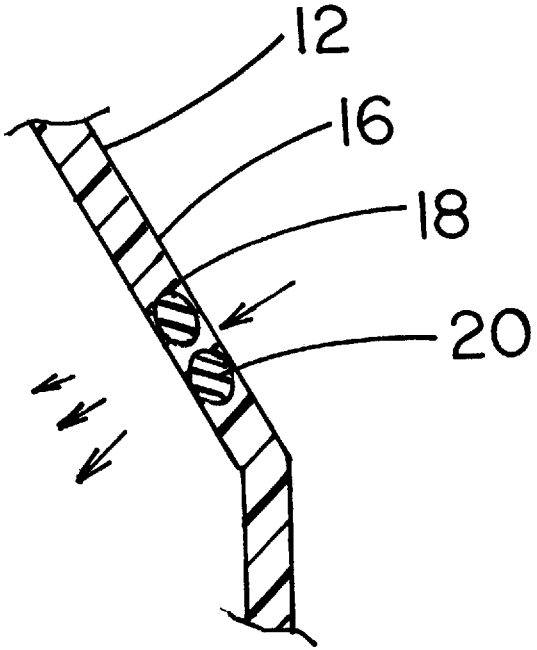
FIG. 2 is a cross-sectional view of the present invention taken along line 2—2 shown in FIG. 1.

With reference now to the drawings, and in particular to FIGS. 1 through 2A thereof, a new automatic air venting rigid plastic baby bottle embodying the principles and concepts of the present invention and generally designated by the reference numeral 10 will be described.

The present invention, designated as numeral 10, includes a rigid container 12 having a circular bottom face and a peripheral side wall integrally coupled thereto and extending upwardly therefrom for defining an interior space. As shown in FIG. 1, the peripheral side wall includes a lower portion 14 with a cylindrical configuration and an upper portion 16 with a frusto-conical configuration. As shown in FIG. 1, the upper portion has a height less than ¼ that of the lower portion of the container.

The upper portion has an annular peripheral lip 17 integrally coupled to its top and extends upwardly therefrom. The lip is equipped with a threaded outer periphery for removably coupling with a nipple. The upper portion of the container further includes a circular bore 18 with a ¼ inch diameter formed therein just above an interconnection between the upper portion and lower portion of the container. As an option, measurement indicia may be printed along the lower portion of the container on a side of the container on which the circular bore resides.

Lastly, a disk-shaped valve 20 formed from an elastomeric material is provided. Ideally, latex is utilized. The valve has a circular outer periphery coupled within an inner periphery of the bore of the container. The valve further includes a normally closed central hole formed therein. As such, an 0-ring is defined.

Upon a suction being applied to an interior space of the container, as in the case of a baby drinking from the bottle, air enters the container through the hole for equalizing pressure therein. This equalization prevents the nipple of the bottle from collapsing. Such collapsing normally results in the baby taking in large amounts of air and further interrupts the feeding process.

In an alternate embodiment, the bore of the aforementioned valve may be equipped with an annular groove formed in the inner periphery thereof. As shown in FIG. 2A, a disk is situated within the groove and spaced from the lips. Further, breathing apertures are formed in the lips which define the groove. In further alternate embodiments, various diaphragms and/or one-way valves may be utilized.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A vented baby bottle comprising, in combination:

a rigid container including a circular bottom face and a peripheral side wall with measurement indicia situated thereon integrally coupled thereto and extending upwardly therefrom for defining an interior space, the peripheral side wall including a lower portion with a cylindrical configuration and an upper portion with a frusto-conical configuration, wherein the upper portion has an annular peripheral lip integrally coupled to its top and extending upwardly therefrom with a threaded outer periphery for removably coupling with a nipple;

said upper portion of the container including a circular bore formed therein adjacent to an interconnection between the upper portion and lower portion of the container; and a disk-shaped valve formed from latex, the valve having a circular outer periphery coupled within an inner periphery of the bore of the container, the valve further including a normally closed central hole formed therein, wherein the disk-shaped valve has a thickness equal to that of the container such that an inboard surface of the valve remains flush with an inner surface of the container and an outboard surface of the valve remains flush with an outer surface of the container, whereby upon a suction being applied to an interior space of the container, air enters the container through the hole for equalizing pressure therein.

2. A vented baby bottle comprising:

a rigid container including a circular bottom face and a peripheral side wall with measurement indicia situated thereon integrally coupled thereto and extending upwardly therefrom for defining an interior space, the peripheral side wall including a lower portion with a cylindrical configuration and an upper portion with a frusto-conical configuration, wherein the upper portion has an annular peripheral lip integrally coupled to its top and extending upwardly therefrom with a threaded outer periphery for removably coupling with a nipple;

said upper portion of the container including a circular bore formed therein adjacent to an interconnection between the upper portion and lower portion of the container, the circular bore having a pair of spaced apart inwardly extending lips which define an annular groove formed between said lips in an inner periphery thereof, wherein an innermost one of the lips has a plurality of apertures formed therein; and a valve including a disk positioned within the annular groove, whereby upon a suction being applied to an interior space of the container, air enters the container through the bore for equalizing pressure therein.

* * * * *